US006599871B2

(12) United States Patent
Smith

(10) Patent No.: US 6,599,871 B2
(45) **Date of Patent: *Jul. 29, 2003**

(54) DETERGENT TABLET

(75) Inventor: David John Smith, Falls Farm Hett (GB)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,141

(22) PCT Filed: Jul. 31, 1998

(86) PCT No.: PCT/US98/16077

§ 371 (c)(1),
(2), (4) Date: Mar. 9, 2000

(87) PCT Pub. No.: WO99/06521

PCT Pub. Date: Feb. 11, 1999

(65) Prior Publication Data

US 2002/0082186 A1 Jun. 27, 2002

(30) Foreign Application Priority Data

Aug. 2, 1997 (GB) ..... 9716303

(51) Int. Cl.[7] ..... C11D 1/722; C11D 11/00; C11D 17/00

(52) U.S. Cl. ..... 510/446; 510/224; 510/356; 510/360; 510/451; 510/531

(58) Field of Search ..... 510/224, 356, 510/360, 446, 451, 531

(56) References Cited

U.S. PATENT DOCUMENTS

| | | | | | |
|---|---|---|---|---|---|
| 4,451,386 A | * | 5/1984 | Joshi | ..... | 252/135 |
| 5,939,373 A | * | 8/1999 | Haeggberg et al. | ..... | 510/220 |

FOREIGN PATENT DOCUMENTS

| | | | | | |
|---|---|---|---|---|---|
| EP | 000076 | * | 12/1978 | | |
| EP | 482627 | * | 4/1992 | | |
| EP | 0 482 627 A1 | | 4/1992 | ..... | C11D/3/10 |
| EP | 0 504 091 A1 | | 9/1992 | ..... | C11D/3/00 |
| EP | 0 711 828 A2 | | 5/1996 | ..... | C11D/17/00 |
| EP | 711828 | * | 5/1996 | | |
| GB | 2 272 450 A | | 5/1994 | ..... | C11D/17/00 |

* cited by examiner

*Primary Examiner*—Yogendra N. Gupta
*Assistant Examiner*—Brian P. Mruk
(74) *Attorney, Agent, or Firm*—Kevin L. Waugh; Marianne Dressman; Brian M. Bolam

(57) ABSTRACT

A detergent tablet containing a nonionic surfactant having a melting point above ambient temperature is suitable for use in an automatic dishwasher or laundry washing machine. Additionally, a process for making a detergent tablet containing such a nonionic surfactant is described.

7 Claims, No Drawings

DETERGENT TABLET

TECHNICAL FIELD

The present invention provides a detergent tablet comprising a nonionic surfactant having a melting point above ambient temperature suitable for use in an automatic dishwasher or laundry washing machine.

BACKGROUND

Detergent tablets in tablet form are known in the art. Detergent compositions in tablet form hold several advantages over particulate detergent compositions, such as ease of handling, transportation and storage. It is the aim of detergent tablet manufacturers to make tablets that are sufficiently hard such that they do not crumble or disintegrate on handling, transportation or storage.

Detergent tablets are traditionally prepared by the compression of a particulate detergent composition in a tablet press. The most common method used by detergent manufacturers to increase tablet hardness is to increase the compression pressure at which the tablets are formed. It has however, been found that dissolution of the tablet generally decreases with increasing compression pressure, leaving a residue of undissolved tablet.

Another consequence of increasing compression pressure is the parallel increase in force of ejection required to eject the tablet from the tablet press. Furthermore increasing compression pressure and force of ejection in the tablet press generally results in the outermost surface of the tablets becoming. In addition high compression pressure and ejection force may cause excessive wearing and potential damage to the tablet press itself. Damage to the outermost surface of the tablet, such as scoring or scratching is unacceptable to the consumer.

Soft tablets that crumble or hard tablets that dissolve slowly, leaving a residue are also unacceptable to the consumer. Detergent manufacturers have thus directed tablet development efforts toward striking a balance between tablet hardness and dissolution.

In addition, soft tablets tend to exhibit high levels of surface dustiness, leaving dust on the hands of the person handling the tablet. Surface dustiness is also unacceptable to the consumer.

EP-A-0,711,828 (Unilever) relates to a process for making tablets by compacting a particulate detergent tablet distributed within which is a binder material. The melting temperature of the binder is in the range of from 35° C. to 90° C. The detergent tablet is compacted at a temperature which is at least 28° C. but below the melting temperature of the binder. Preferably the binder is polyethylene glycol; a costly additional detergent component providing no detersive benefits.

It is the object of the present invention to provide a detergent tablet that is not only sufficiently hard to meet handling, transportation and storage needs without compromising the rate of dissolution, but which exhibits reduced surface dustiness and can also be readily ejected from the tablet press without causing damage to the outermost surface of the tablet or the tablet press.

SUMMARY OF THE INVENTION

According to the present invention there is provided a detergent tablet comprising a nonionic surfactant having a melting point above ambient temperature and wherein the detergent tablet is obtainable by a process comprising the steps of:

a) heating the nonionic surfactant to above its melting point to form a liquid nonionic surfactant;

b) applying the liquid nonionic surfactant to a premix of detergent components to form a detergent composition;

c) forming the detergent composition into tablets.

In addition there is also provided a detergent tablet wherein the detergent tablet is formed in a tablet press and is ejected from the tablet press at a temperature below the melting point of the nonionic surfactant.

DETAILED DESCRIPTION OF THE INVENTION

Nonionic Surfactant

The detergent tablets of the present invention comprise a nonionic surfactant having a melting point above ambient temperature.

Suitable nonionic surfactants include any low foaming nonionic surfactant suitable for incorporation into an automatic dishwashing or laundry detergent composition with a melting point above ambient temperature such the surfactant is preferably solid or but may be highly viscous (at least 20,000 cps, preferably at least 35,000 cps, most preferably at least 40,000 cps) or wax-like at ambient temperature. Preferably the nonionic surfactant provides satisfactory suds control.

The nonionic surfactants suitable for use herein have a melting point of preferably greater than 35° C., more preferably greater than 25° C. More preferably the nonionic surfactant has a melting point of between 25° C. and 60° C., more preferably between 26.6° C. and 43.3° C.

Preferred nonionic surfactants include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have sud suppressing action, especially in relation to common food soil ingredients such as egg.

In a preferred embodiment, the nonionic surfactant is an ethoxylated surfactant derived from the reaction of a monohydroxy alcohol or alkylphenol containing from 6 to 20 carbon atoms, with preferably at least 12 moles, more preferably at least 15 moles, most preferably at least 20 moles of ethylene oxide per mole of alcohol or alkyl phenol on an average basis.

A particularly preferred nonionic surfactant is derived from a straight chain fatty alcohol containing from 16 to 20 carbon atoms ($C_{16}$–$C_{20}$ alcohol), preferably a $C_{18}$ alcohol, condensed with an average of preferably at least 12 moles, more preferably at least 15 moles, and most preferably at least 20 moles of ethylene oxide per mole of alcohol. Preferably the ethoxylated nonionic surfactant so derived has a narrow ethoxylate distribution relative to the average.

The nonionic surfactant preferably also contains propylene oxide groups. Preferably the nonionic surfactants contain propylene oxide groups in an amount up to 25% by weight, preferably up to 20% by weight, most preferably up to 15% by weight of the total nonionic surfactant.

Highly preferred nonionic surfactants are ethoxylated monohydroxy alcohols or alkyl phenols additionally comprising a polyoxyethylene, polyoxypropylene block polymeric compound; the ethoxylated monohydroxy alcohol or alkyl phenol fraction of the nonionic surfactant comprising greater than 30%, preferably greater than 50%, most preferably greater than 70% of the total nonionic surfactant.

A particularly preferred nonionic surfactant contains from 40% to 70% of a polyoxypropylene/polyoxyethylene/ polyoxypropylene block polymer blend comprising 75%, by weight of the blend, of a reverse block co-polymer of polyoxyethylene and polyoxypropylene containing 17 moles of ethylene oxide and 44 moles of propylene oxide; and 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Nonionic surfactant which may also be used include those POLY-TERGENT® SLF-18 nonionic surfactants from Olin Corp., having the melting point properties discussed herein above.

A preferred nonionic surfactant has the general formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms including mixtures thereof; $R_2$ is a linear or branched aliphatic hydrocarbon radical having from 2 to 26 carbon atoms including mixtures thereof; x is an integer having an average value of from 0.5 to 1.5; and y is an integer having a value of least 15.

Another preferred nonionic surfactant is the ether-capped poly(oxyalkylated) alcohol surfactants having the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from 1 to 30 carbon atoms; $R^3$ is H, or a linear aliphatic hydrocarbon radical having from 1 to 4 carbon atoms; x is an integer having an average value from 1 to 30, wherein when x is 2 or greater $R^3$ may be the same or different and k and j are integers having an average value of from 1 to 12, and more preferably 1 to 5.

$R^1$ and $R^2$ are preferably linear or branched, saturated or unsaturated, aliphatic or aromatic hydrocarbon radicals having from 6 to 22 carbon atoms with 8 to 18 carbon atoms being most preferred. H or a linear aliphatic hydrocarbon radical having from 1 to 2 carbon atoms is most preferred for $R^3$. Preferably, x is an integer having an average value of from 1 to 20, more preferably from 6 to 15.

As described above, when, in the preferred embodiments, and x is greater than 2, $R^3$ may be the same or different. That is, $R^3$ may vary between any of the alklyeneoxy units as described above. For instance, if x is 3, $R^3$ may be selected to form ethlyeneoxy(EO) or propyleneoxy(PO) and may vary in order of (EO)(PO)(EO), (EO)(EO)(PO); (EO)(EO)(EO); (PO)(EO)(PO); (PO)(PO)(EO) and (PO)(PO)(PO). Of course, the integer three is chosen for example only and the variation may be much larger with a higher integer value for x and include, for example, multiple (EO) units and a much small number of (PO) units.

Most preferred ether-capped poly(oxyalkylated) alcohol surfactants are those wherein k is 1 and j is 1 so that the surfactants have the formula:

$$R^1O[CH_2CH(R^3)O]_xCH_2CH(OH)CH_2OR^2$$

where $R^1$, $R^2$ and $R^3$ are defined as above and x is an integer with an average value of from 1 to 30, preferably from 1 to 20, and even more preferably from 6 to 18. Most preferred are surfactants wherein $R^1$ and $R^2$ range from 9 to 14, $R^3$ is H forming ethyleneoxy and x ranges from 6 to 15.

The ether-capped poly(oxyalkylated) alcohol surfactants comprise three general components, namely a linear or branched alcohol, an alkylene oxide and an alkyl ether end cap. The alkyl ether end cap and the alcohol serve as a hydrophobic, oil-soluble portion of the molecule while the alkylene oxide group forms the hydrophilic, water-soluble portion of the molecule.

Generally speaking, the ether-capped poly(oxyalkylene) alcohol surfactants of the present invention may be produced by reacting an aliphatic alcohol with an epoxide to form an ether which is then reacted with a base to form a second epoxide. The second epoxide is then reacted with an alkoxylated alcohol to form the novel compounds of the present invention. Examples of methods of preparing the ether-capped poly(oxyalkylated) alcohol surfactants are described below:

Preparation of $C_{12/14}$ Alkyl Glycidyl Ether

A $C_{12/14}$ fatty alcohol (100.00 g, 0.515 mol.) and tin (IV) chloride (0.58 g, 2.23 mmol, available from Aldrich) are combined in a 500 mL three-necked round-bottomed flask fitted with a condenser, argon inlet, addition funnel, magnetic stirrer and internal temperature probe. The mixture is heated to 60° C. Epichlorhydrin (47.70 g, 0.515 mol, available from Aldrich) is added dropwise so as to keep the temperature between 60–65° C. After stirring an additional hour at 60° C., the mixture is cooled to room temperature. The mixture is treated with a 50% solution of sodium hydroxide (61.80 g, 0.773 mol, 50%) while being stirred mechanically. After addition is completed, the mixture is heated to 90° C. for 1.5 h, cooled, and filtered with the aid of ethanol. The filtrate is separated and the organic phase is washed with water (100 mL), dried over $MgSO_4$, filtered, and concentrated. Distillation of the oil at 100–120° C. (0.1 mm Hg) providing the glycidyl ether as an oil.

Preparation of $C_{12/14}$ Alkyl-$C_{9/11}$ Ether Capped Alcohol Surfactant

Neodol® 91-8 (20.60 g, 0.0393 mol ethoxylated alcohol available from the Shell chemical Co.) and tin (IV) chloride (0.58 g, 2.23 mmol) are combined in a 250 mL three-necked round-bottomed flask fitted with a condenser, argon inlet, addition funnel, magnetic stirrer and internal temperature probe. The mixture is heated to 60° C. at which point $C_{12/14}$ alkyl glycidyl ether (11.00 g, 0.0393 mol) is added dropwise over 15 min. After stirring for 18 h at 60° C., the mixture is cooled to room temperature and dissolved in an equal portion of dichloromethane. The solution is passed through a 1 inch pad of silica gel while eluting with dichloromethane. The filtrate is concentrated by rotary evaporation and then stripped in a kugelrohr oven (100° C., 0.5 mm Hg) to yield the surfactant as an oil.

Particularly preferred nonionic surfactants have relatively low cloud points and high hydrophilic-lipophilic balance (HLB). Cloud points of 1% solutions in water are typically below 32° C. and preferably lower, e.g., the cloud point is preferably 0° C., for optimum control of sudsing throughout a fall range of water temperatures.

The surfactant is typically present at a level of from 0.1% to 30% by weight, more preferably from 0.5% to 10% by weight, most preferably from 1% to 5% by weight of the tablets.

Process

The detergent tablets of the present invention are obtainable by a process comprising the steps of:

a) heating the nonionic surfactant to above its melting point to form a liquid nonionic surfactant;

b) applying the liquid nonionic surfactant to a premix of detergent components to form a detergent composition;

c) forming the detergent composition into tablets.

The detergent tablet can be prepared using any suitable compression process, such as tabletting, briquetting or extrusion, but preferably tabletting. Any conventional technique for forming tablets may be used. Preferably tablets are prepared using a standard rotary tabletting press using compression pressure of from 5 to 13 KN/cm$^2$, more preferably from 6 to 11 KN/cm$^2$ so that the compressed solid has hardness of 176 N to 275 N, preferably from 195 N to 245 N, measured by a C100 hardness test as supplied by I. Holland instruments. This process may be used to prepare homogeneous or layered tablets of any size or shape. Preferably the tablets weigh between 15 g and 80 g, more preferably between 18 g and 70 g, most preferably between 20 g and 60 g. Preferably tablets are symmetrical to ensure the uniform dissolution of the tablet in the wash solution.

Both industrial and small scale production of the detergent composition prepared by the process of the present invention are envisaged. Preferred equipment should be selected according to the scale of production required.

A premix of detergent components are combined in a suitable mixer, for example a batch or continuous mixer. Nonionic surfactant is applied to the premix by any suitable method to form a detergent composition; preferably the nonionic surfactant is sprayed onto the premix to form a detergent composition. The nonionic surfactant is applied to the premix at a temperature above the melting temperature of the nonionic surfactant, preferably at least 5° C., more preferably at least 10° C. above the melting temperature of the nonionic surfactant. At the time of application of the nonionic surfactant to the premix the temperature difference between the nonionic surfactant and the premix is preferably less than 30° C., more preferably less than 25° C., most preferably less than 20° C.

In a preferred embodiment the detergent composition is maintained at a temperature above the melting point of the nonionic surfactant until the detergent composition is delivered to the tablet press.

The detergent composition is then delivered to the tablet press. In a preferred embodiment of the present invention the tablet press is heated to a temperature within a range of between 10° C. above and 10° C. below, more preferably within the range of between 7° C. above and 7° C. below, most preferably within the range of between 5° C. above and 5° C. below the melting point of the nonionic surfactant. The detergent composition is compressed at a compression pressure of from 5 to 13 KN/cm$^2$, more preferably from 6 to 11 KN/cm$^2$.

The detergent tablet is ejected from the tablet press using an ejecting force of less than 40 KN, preferably less than 30 KN, most preferably less than 10 KN. In a preferred aspect of the present invention the tablets are ejected from the tablet press when the detergent tablets have cooled to a temperature at least 5° C., preferably at least 7° C., most preferably at least 10° C. below the melting point of the nonionic surfactant. It may be advantageous to allow the tablets to cool as described, to achieve easier ejection of the tablet from the tablet press. When the nonionic surfactant of the present invention is present at a temperature below melting point and is therefore solid, it provides a lubrication benefit, aiding the ejection of the tablet from the tablet press. The tablets can thus be ejected from the tablet press using less force, thereby incurring less damage to the surface of the tablet or the tablet press.

Additional Detergent Components

The detergent tablets described herein are prepared by compression of a detergent composition. Suitable detergent compositions may include a variety of different ingredients including builder compounds, additional surfactants, enzymes, bleaching agents, alkalinity sources, lime soap dispersants, organic polymeric compounds including polymeric dye transfer inhibiting agents, crystal growth inhibitors, heavy metal ion sequestrants, metal ion salts, enzyme stabilisers, corrosion inhibitors, suds suppressers, solvents, fabric softening agents, optical brighteners and hydrotropes.

Highly preferred components of the detergent tablet as described earlier include a builder compound, a surfactant, an enzyme and a bleaching agent.

Builder Compound

The detergent tablets of the present invention preferably contain a builder compound, typically present at a level of from 1% to 80% by weight, preferably from 10% to 70% by weight, most preferably from 20% to 60% by weight of the tablet.

Water-soluble Builder Compound

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that 50° C., especially less than 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Partially Soluble or Insoluble Builder Compound

The detergent tablets of the present invention may contain a partially soluble or insoluble builder compound. Partially soluble and insoluble builder compounds are particularly suitable for use in tablets prepared for use in laundry cleaning methods. Examples of partially water soluble builders include the crystalline layered silicates as disclosed for example, in EP-A-0164514, DE-A-3417649 and DE-A-3742043. Preferred are the crystalline layered sodium silicates of general formula $$NaMSi_xO_{2+1}.yH_2O$$

wherein M is sodium or hydrogen, x is a number from 1.9 to 4 and y is a number from 0 to 20. Crystalline layered sodium silicates of this type preferably have a two dimensional 'sheet' structure, such as the so called δ-layered structure, as described in EP 0 164514 and EP 0 293640.

Methods for preparation of crystalline layered silicates of this type are disclosed in DE-A-3417649 and DE-A-3742043. For the purpose of the present invention, x in the general formula above has a value of 2, 3 or 4 and is preferably 2.

The most preferred crystalline layered sodium silicate compound has the formula $\delta$-$Na_2Si_2O_5$, known as NaSKS-6 (trade name), available from Hoechst AG.

The crystalline layered sodium silicate material is preferably present in granular detergent tablets as a particulate in intimate admixture with a solid, water-soluble ionisable material as described in PCT Patent Application No. WO92/18594. The solid, water-soluble ionisable material is selected from organic acids, organic and inorganic acid salts and mixtures thereof, with citric acid being preferred.

Examples of largely water insoluble builders include the sodium aluminosilicates. Suitable aluminosilicates include the aluminosilicate zeolites having the unit cell formula $Na_z[(AlO_2)_z(SiO_2)y]$. $xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof.

A preferred method of synthesizing aluminosilicate zeolites is that described by Schoeman et al (published in Zeolite (1994) 14(2), 110–116), in which the author describes a method of preparing colloidal aluminosilicate zeolites. The colloidal aluminosilicate zeolite particles should preferably be such that no more than 5% of the particles are of size greater than 1 μm in diameter and not more than 5% of particles are of size less then 0.05 μm in diameter. Preferably the aluminosilicate zeolite particles have an average particle size diameter of between 0.01 μm and 1 μm, more preferably between 0.05 μm and 0.9 μm, most preferably between 0.1 μm and 0.6 μm.

Zeolite A Has the Formula $$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}]$. 276 $H_2O$. Zeolite MAP, as disclosed in EP-B-384,070 is a preferred zeolite builder herein.

Preferred aluminosilicate zeolites are the colloidal aluminosilicate zeolites. When employed as a component of a detergent tablet colloidal aluminosilicate zeolites, especially colloidal zeolite A, provide enhanced builder performance in terms of providing improved stain removal. Enhanced builder performance is also seen in terms of reduced fabric encrustation and improved fabric whiteness maintenance; problems believed to be associated with poorly built detergent tablets.

A surprising finding is that mixed aluminosilicate zeolite detergent tablets comprising colloidal zeolite A and colloidal zeolite Y provide equal calcium ion sequestration performance versus an equal weight of commercially available zeolite A. Another surprising finding is that mixed aluminosilicate zeolite detergent tablets, described above, provide improved magnesium ion sequestration performance versus an equal weight of commercially available zeolite A.

Additional Surfactant

The detergent tablet of the present invention may comprise additional surfactants. Suitable surfactants are selected from anionic, cationic, nonionic, ampholytic and zwitterionic surfactants and mixtures thereof. Automatic dishwashing machine products should be low foaming in character and thus the foaming of the surfactant system for use in dishwashing methods must be suppressed or more preferably be low foaming, typically nonionic in character. Sudsing caused by surfactant systems used in laundry cleaning methods need not be suppressed to the same extent as is necessary for dishwashing. The surfactant is typically present at a level of from 0.2% to 30% by weight, more preferably from 0.5% to 10% by weight, most preferably from 1% to 5% by weight of the tablets.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent tablets is given for example, in EP-A-0414 549 and PCT Applications Nos. WO 93/08876 and WO 93/08874.

Additional Nonionic Surfactant

Essentially any nonionic surfactants useful for detersive purposes can be additionally included in the tablets. Preferred, non-limiting classes of useful nonionic surfactants are listed below.

Nonionic Ethoxylated Alcohol Surfactant

The alkyl ethoxylate condensation products of aliphatic alcohols with from 1 to 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from 1500 to 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

Anionic Surfactant

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl—N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON($R^1$)$CH_2$COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent tablets hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Cationic ester surfactants used in this invention are preferably water dispersible compound having surfactant properties comprising at least one ester (i.e. —COO—) linkage and at least one cationically charged group. Other suitable cationic ester surfactants, including choline ester surfactants, have for example been disclosed in U.S. Pat. Nos. 4,228,042, 4,239,660 and 4,260,529.

Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Enzymes

The detergent tablets may comprise an enzyme. Said enzymes include enzymes selected from cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

Preferably the detergent tablets of the present invention comprise a cocktail of conventional applicable enzymes such as protease, amylase, lipase, cutinase and/or cellulase in conjunction with one or more plant cell wall degrading enzymes.

The cellulases usable in the present invention include both bacterial or fungal cellulase. Preferably, they will have a pH optimum of between 5 and 12 and an activity above 50 CEVU (Cellulose Viscosity Unit). Suitable cellulases are disclosed in U.S. Pat. No. 4,435,307, Barbesgoard et al, J61078384 and WO96/02653 which disclose fungal cellulases produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of 50 KDa, an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in PCT Patent Application No. WO 91/17243. Also suitable cellulases are the EGIII cellulases from Trichoderma longibrachiatum described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Said cellulases are normally incorporated in the detergent tablet at levels from 0.0001% to 2% of active enzyme by weight of the detergent tablet.

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Peroxidase-containing detergent tablets are disclosed, for example, in PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Preferred enhancers are substitued phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substitued syringates (C3–C5 substitued alkyl syringates) and phenols. Sodium percarbonate or perborate are preferred sources of hydrogen peroxide.

Said cellulases and/or peroxidases are normally incorporated in the detergent tablet at levels from 0.0001% to 2% of active enzyme by weight of the detergent tablet.

Other preferred enzymes that can be included in the detergent tablets of the present invention include lipases. Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum var. lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase$^R$ and Lipomax$^R$ (Gist-Brocades) and Lipolase$^R$ and Lipolase Ultra$^R$(Novo) which have found to be very effective when used in combination with the tablets of the present invention. Also suitables are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to detergent tablets have been described in e.g. WO-A-88/09367 (Genencor); WO 90/09446 (Plant Genetic System) and WO 94/14963 and WO 94/14964 (Unilever).

The lipases and/or cutinases are normally incorporated in the detergent tablet at levels from 0.0001% to 2% of active enzyme by weight of the detergent tablet.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is what is called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO95/10591 and in the patent application of C. Ghosh, et al, "Bleaching Tablets Comprising Protease Enzymes" having U.S. Ser. No. 08/322,677, filed Oct. 13, 1994.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

The proteolytic enzymes are incorporated in the detergent tablets of the present invention a level of from 0.0001% to 2%, preferably from 0.001% to 0.2%, more preferably from 0.005% to 0.1% pure enzyme by weight of the tablet.

Amylases (α and/or β) can be included for removal of carbohydrate-based stains. WO94/02597, Novo Nordisk A/S published Feb. 03, 1994, describes cleaning tablets which incorporate mutant amylases. See also WO95/10603, Novo Nordisk A/S, published Apr. 20, 1995. Other amylases known for use in cleaning tablets include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314, published Aug. 18, 1994 and WO96/05295, Genencor, published Feb. 22, 1996 and amylase variants having additional modification in the immediate parent available from Novo Nordisk A/S, disclosed in WO 95/10603, published April 1995. Also suitable are amylases described in EP 277 216, WO95/26397 and WO96/23873 (all by Novo Nordisk).

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The amylolytic enzymes are incorporated in the detergent tablets of the present invention a level of from 0.0001% to 2%, preferably from 0.00018% to 0.06%, more preferably from 0.00024% to 0.048% pure enzyme by weight of the tablet.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Said enzymes are normally incorporated in the detergent tablet at levels from 0.0001% to 2% of active enzyme by weight of the detergent tablet. The enzymes can be added as separate single ingredients (prills, granulates, stabilized liquids, etc. containing one enzyme) or as mixtures of two or more enzymes (e.g. cogranulates).

Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

A range of enzyme materials and means for their incorporation into synthetic detergent tablets is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Bleaching Agent

A highly preferred component of the detergent tablet is a bleaching agent. Suitable bleaching agents include chlorine and oxygen-releasing bleaching agents.

In one preferred aspect the oxygen-releasing bleaching agent contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred aspect a preformed organic peroxyacid is incorporated directly into the tablet. Tablets containing mixtures of a hydrogen peroxide source and organic peroxyacid precursor in combination with a preformed organic peroxyacid are also envisaged.

Inorganic Perhydrate Bleaches

The tablets in accord with the invention preferably include a hydrogen peroxide source, as an oxygen-releasing bleach. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the tablets.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular tablets utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in tablets in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such tablets in a coated form which provides in-product stability.

A suitable coating material providing in product stability comprises mixed salt of a water soluble alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Another suitable coating material providing in product stability, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility in the tablets herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

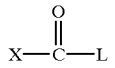

where L is a leaving group and X is essentially any functionality, such that on perhydrolysis the structure of the peroxyacid produced is

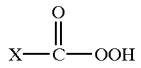

Peroxyacid bleach precursor compounds are preferably incorporated at a level of from 0.5% to 20% by weight, more preferably from 1% to 10% by weight, most preferably from 1.5% to 5% by weight of the tablets.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching tablet.

Preferred L groups are selected from the group consisting of:

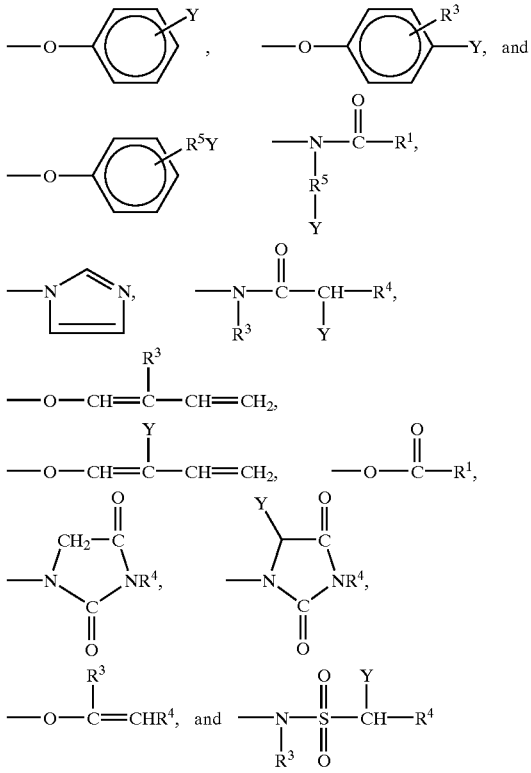

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^-$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

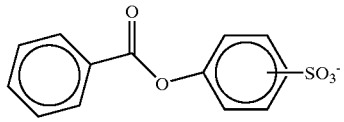

Also suitable are the benzoylation products of sorbitol, glucose, and all saccharides with benzoylating agents, including for example:

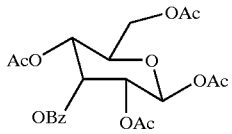

Ac=$COCH_3$; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

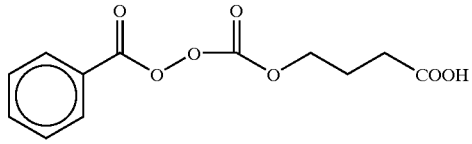

Phthalic anhydride is another suitable perbenzoic acid precursor compound herein:

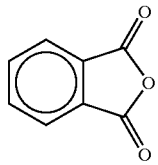

Suitable N-acylated lactam perbenzoic acid precursors have the formula:

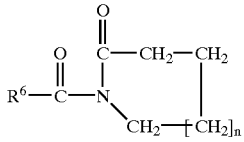

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

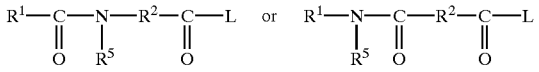

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the tablets as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

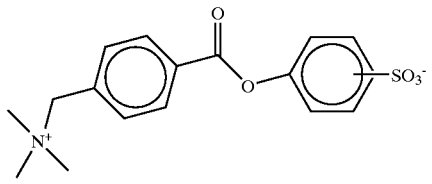

A preferred cationically substituted alkyl oxybenzene sulfonate has the formula:

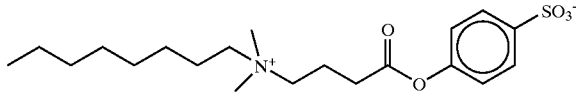

Preferred cationic peroxyacid precursors of the N-acylated caprolactam class include the trialkyl ammonium methylene benzoyl caprolactams, particularly trimethyl ammonium methylene benzoyl caprolactam:

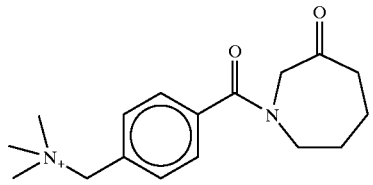

Other preferred cationic peroxyacid precursors of the N-acylated caprolactam class include the trialkyl ammonium methylene alkyl caprolactams:

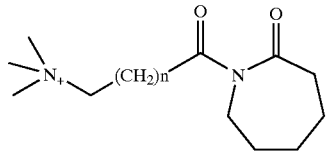

where n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxyacid Precursors

Amide substituted alkyl peroxyacid precursor compounds are also suitable, including those of the following general formulae:

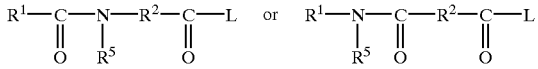

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

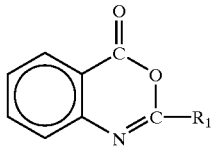

including the substituted benzoxazins of the type

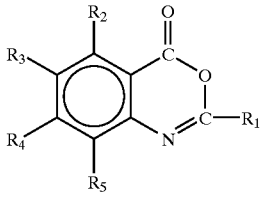

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

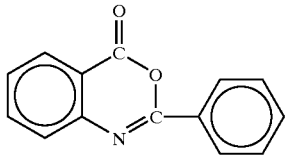

Preformed Organic Peroxyacid

The organic peroxyacid bleaching system may contain, in addition to, or as an alternative to, an organic peroxyacid bleach precursor compound, a preformed organic peroxyacid, typically at a level of from 0.5% to 25% by weight, more preferably from 1% to 10% by weight of the tablet.

A preferred class of organic peroxyacid compounds are the amide substituted compounds of the following general formulae:

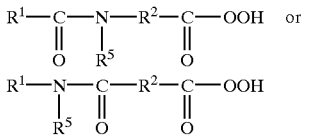

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Metal-containing Bleach Catalyst

The bleach tablets described herein may additionally contain as a preferred component, a metal containing bleach catalyst. Preferably the metal containing bleach catalyst is a transition metal containing bleach catalyst, more preferably a manganese or cobalt-containing bleach catalyst.

A suitable type of bleach catalyst is a catalyst comprising a heavy metal cation of defined bleach catalytic activity, such as copper, iron cations, an auxiliary metal cation having little or no bleach catalytic activity, such as zinc or aluminium cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Preferred types of bleach catalysts include the manganese-based complexes disclosed in U.S. Pat. Nos. 5,246,621 and 5,244,594. Preferred examples of these catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful in the tablets herein may also be selected as appropriate for the present invention. For examples of suitable bleach catalysts see U.S. Pat. Nos. 4,246,612 and 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

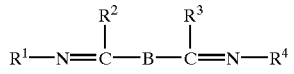

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Preferred examples include binuclear Mn complexes with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn-ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Other preferred examples include cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining co-ordination sites stabilise the cobalt under automatic dishwashing conditions such that the reduction potential for cobalt (III) to cobalt (II) under alkaline conditions is less than 0.4 volts (preferably less than 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention tablets which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand co-ordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'_4{}^+$, wherein n is an integer from 1 to 16, preferably from 2 to 10, and most preferably from 2 to 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAC](OAc)_2$; $[Co(NH_3)_5OAc](PF_6)_2$; $[Co(NH_3)_5OAc](SO_4)$; $[Co_(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952); as well as the synthesis examples provided hereinafter.

These catalysts may be co-processed with adjunct materials so as to reduce the colour impact if desired for the aesthetics of the product, or to be included in enzyme-containing particles as exemplified hereinafter, or the tablets may be manufactured to contain catalyst "speckles".

Water-soluble Sulphate Salt

The detergent tablet optionally contains a water-soluble sulphate salt. Where present the water-soluble sulphate salt is at the level of from 0.1% to 40%, more preferably from 1% to 30%, most preferably from 5% to 25% by weight of the tablets.

The water-soluble sulphate salt may be essentially any salt of sulphate with any counter cation. Preferred salts are selected from the sulphates of the alkali and alkaline earth metals, particularly sodium sulphate.

Alkali Metal Silicate

A preferred component of the detergent tablet is an alkali metal silicate. A preferred alkali metal silicate is sodium silicate having an $SiO_2$:$Na_2O$ ratio of from 1.8 to 3.0, preferably from 1.8 to 2.4, most preferably 2.0. Sodium silicate is preferably present at a level of less than 20%, preferably from 1% to 15%, most preferably from 3% to 12% by weight of $SiO_2$. The alkali metal silicate may be in the form of either the anhydrous salt or a hydrated salt.

Hydrocarbon Oils

Another detergent component preferably incorporated into the detergent tablets suitably used in dishwashing methods is a hydrocarbon oil; typically a predominantly long chain, aliphatic hydrocarbons having a number of carbon atoms in the range of from 20 to 50; preferred hydrocarbons are saturated and/or branched; preferred hydrocarbon oil selected from predominantly branched $C_{25-45}$ species with a ratio of cyclic to noncyclic hydrocarbons of from 1:10 to 2:1, preferably from 1:5 to 1:1. A preferred hydrocarbon oil is paraffin. A paraffin oil meeting the characteristics as outlined above, having a ratio of cyclic to noncyclic hydrocarbons of 32:68, is sold by Wintershall, Salzbergen, Germany, under the trade name WINOG 70.

Water-soluble Bismuth Compound

The tablets described herein may contain a water-soluble bismuth compound, preferably present at a level of from 0.005% to 20%, more preferably from 0.01% to 5%, most preferably from 0.1% to 1% by weight of the tablets.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Corrosion Inhibitor Compound

The tablets of the present invention suitable for use in dishwashing methods may contain corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO94/16047 and copending European application No. EP-A-690122. Nitrogen-containing corrosion inhibitor compounds are disclosed in copending European Application no. EP-A-634,478. Mn(II) compounds for use in corrosion inhibition are described in copending European Application No. EP-A-672 749.

Organic silver coating agent may be incorporated at a level of from 0.05% to 10%, preferably from 0.1% to 5% by weight of the total tablet.

The functional role of the silver coating agent is to form 'in use' a protective coating layer on any silverware components of the washload to which the tablets of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to 40 carbon atoms in the hydrocarbon chain.

The fatty acid portion of the fatty ester can be obtained from mono- or poly-carboxylic acids having from 1 to 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, Valerie acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Fatty acid esters useful herein include:xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from 35° C. to 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents can also be used as an organic silver coating agent.

Suitable polymeric soil release agents include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful herein also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al.

Another suitable soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 to Hays, issued May 25, 1976 and U.S. Pat. No. 3,893,929 to Basadur issued Jul. 8, 1975.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Other polymeric soil release agents also include the soil release agents of U.S. Pat. No. 4,877,896, issued Oct. 31, 1989 to Maldonado et al, which discloses anionic, especially sulfoarolyl, end-capped terephthalate esters.

Another soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulfonate.

A preferred organic silver coating agent is a paraffin oil, typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of from 1:10 to 2:1, preferably from 1:5 to 1:1. A paraffin oil meeting these characteristics, having a ratio of cyclic to noncyclic hydrocarbons of 32:68, is sold by Wintershall, Salzbergen, Germany, under the trade name WINOG 70.

Nitrogen-containing Corrosion Inhibitor Compounds

Suitable nitrogen-containing corrosion inhibitor compounds include imidazole and derivatives thereof such as benzimidazole, 2-heptadecyl imidazole and those imidazole derivatives described in Czech Patent No. 139,279 and British Patent GB-A-1,137,741, which also discloses a method for making imidazole compounds.

Also suitable as nitrogen-containing corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) Corrosion Inhibitor Compounds

The tablets may contain an Mn(II) corrosion inhibitor compound. The Mn(II) compound is preferably incorporated at a level of from 0.005% to 5% by weight, more preferably from 0.01% to 1%, most preferably from 0.02% to 0.4% by weight of the tablets. Preferably, the Mn(II) compound is incorporated at a level to provide from 0.1 ppm to 250 ppm, more preferably from 0.5 ppm to 50 ppm, most preferably from 1 ppm to 20 ppm by weight of Mn(II) ions in any bleaching solution.

The Mn (II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other Corrosion Inhibitor Compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octadecane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Total Available Oxygen (AvO) Level

It has been found that, for optimal anti-silver tarnishing performance, the level of available oxygen in the present tablets, measured in units of % available oxygen by weight of the tablet, is preferably controlled; the level of available oxygen should hence preferably be in the range from 0.3% to 2.5%, preferably from 0.5% to 1.7%, more preferably from 0.6% to 1.5%, most preferably from 0.7% to 1.2%, measured according to the method described hereunder.

Rate of Release of AvO

The rate of release of available oxygen is preferably also controlled; the rate of release of available oxygen from the tablets herein preferably should be such that, when using the method described hereinafter, the available oxygen is not completely released from the tablet until after 3.5 minutes, preferably the available oxygen is released in a time interval of from 3.5 minutes to 10.0 minutes, more preferably from 4.0 minutes to 9.0 minutes, most preferably from 5.0 minutes to 8.5 minutes.

Method for Measuring Level of Total Available Oxygen (AvO) and Rate of Release of AvO in a Detergent Tablet Method 1. A beaker of water (typically 2 L) is placed on a stirrer Hotplate, and the stirrer speed is selected to ensure that the product is evenly dispersed through the solution.
2. The detergent tablet (typically 8 g of product which has been sampled down from a bulk supply using a Pascal sampler), is added and simultaneously a stop clock is started.

3. The temperature control should be adjusted so as to maintain a constant temperature of 20° C. throughout the experiment.
4. Samples are taken from the detergent solution at 2 minute time intervals for 20 minutes, starting after 1 minute, and are titrated by the "titration procedure" described below to determine the level of available oxygen at each point.

Titration Procedure

1. An aliquot from the detergent solution (above) and 2 ml sulphuric acid are added into a stirred beaker
2. Approximately 0.2 g ammonium molybdate catalyst (tetra hydrate form) are added
3. 3 mls of 10% sodium iodide solution are added
4. Titration with sodium thiosulphate is conducted until the end point. The end point can be seen using either of two procedures. First procedure consists simply in seeing the yellow iodine colour fading to clear. The second and preferred procedure consists of adding soluble starch when the yellow colour is becoming faint, turning the solution blue. More thiosulphate is added until the end point is reached (blue starch complex is decolourised).

The level of AvO, measured in units of % available oxygen by weight, for the sample at each time interval corresponds to the amount of titre according to the following equation $$\frac{Vol\ S_2O_3(\text{ml}) \times \text{Molarity}\ (S_2O_3) \times 8}{\text{Sample mass}\ (g)}$$

AvO level is plotted versus time to determine the maximum level of AvO, and the rate of release of AvO Controlled Rate of Release—means A means may be provided for controlling the rate of release of oxygen bleach to the wash solution.

Means for controlling the rate of release of the bleach may provide for controlled release of peroxide species to the wash solution. Such means could, for example, include controlling the release of any inorganic perhydrate salt, acting as a hydrogen peroxide source, to the wash solution.

Suitable controlled release means can include coating any suitable component with a coating designed to provide the controlled release. The coating may therefore, for example, comprise a poorly water soluble material, or be a coating of sufficient thickness that the kinetics of dissolution of the thick coating provide the controlled rate of release.

The coating material may be applied using various methods. Any coating material is typically present at a weight ratio of coating material to bleach of from 1:99 to 1:2, preferably from 1:49 to 1:9.

Suitable coating materials include triglycerides (e.g. partially) hydrogenated vegetable oil, soy bean oil, cotton seed oil) mono or diglycerides, microcrystalline waxes, gelatin, cellulose, fatty acids and any mixtures thereof.

Other suitable coating materials can comprise the alkali and alkaline earth metal sulphates, silicates and carbonates, including calcium carbonate and silicas.

A preferred coating material, particularly for an inorganic perhydrate salt bleach source, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating.

Any inorganic salt coating materials may be combined with organic binder materials to provide composite inorganic salt/organic binder coatings. Suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average molecular weight of from 12,000 to 700,000 and polyethylene glycols (PEG) with an average molecular weight of from 600 to $5\times10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Cellulose derivatives such as methylcellulose, carboxymethylcellulose and hydroxyethylcellulose, and homo- or co-polymeric polycarboxylic acids or their salts are other examples of binders suitable for use herein.

One method for applying the coating material involves agglomeration. Preferred agglomeration processes include the use of any of the organic binder materials described hereinabove. Any conventional agglomerator/mixer may be used including, but not limited to pan, rotary drum and vertical blender types. Molten coating tablets may also be applied either by being poured onto, or spray atomized onto a moving bed of bleaching agent.

Other means of providing the required controlled release include mechanical means for altering the physical characteristics of the bleach to control its solubility and rate of release. Suitable protocols could include compression, mechanical injection, manual injection, and adjustment of the solubility of the bleach compound by selection of particle size of any particulate component.

Whilst the choice of particle size will depend both on the tablet of the particulate component, and the desire to meet the desired controlled release kinetics, it is desirable that the particle size should be more than 500 micrometers, preferably having an average particle diameter of from 800 to 1200 micrometers.

Additional protocols for providing the means of controlled release include the suitable choice of any other components of the detergent tablet matrix such that when the tablet is introduced to the wash solution the ionic strength environment therein provided enables the required controlled release kinetics to be achieved.

Alkalinity System

The tablets preferably contain an alkalinity system containing sodium silicate having an $SiO_2$:$Na_2O$ ratio of from 1.8 to 3.0, preferably from 1.8 to 2.4, most preferably 2.0, present preferably at a level of less than 20%, preferably from 1% to 15%, most preferably from 3% to 12% by weight of $SiO_2$. The alkali metal silicate may be in the form of either the anhydrous salt or a hydrated salt.

The alkalinity system also preferably contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Heavy Metal Ion Sequestrant

The detergent tablets of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the tablets.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof Preferred EDDS compounds are the free acid form and the sodium or magnesium salt or complex thereof.

Crystal Growth Inhibitor Component

The detergent tablets preferably contain a crystal growth inhibitor component, preferably an organodiphosphonic acid component, incorporated preferably at a level of from 0.01% to 5%, more preferably from 0.1% to 2% by weight of the tablets.

By organo diphosphonic acid it is meant herein an organo diphosphonic acid which does not contain nitrogen as part of its chemical structure. This definition therefore excludes the organo aminophosphonates, which however may be included in tablets of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Enzyme Stabilizing System

Preferred enzyme-containing tablets herein may comprise from 0.001% to 10%, preferably from 0.005% to 8%, most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Organic Polymeric Compound

Organic polymeric compounds may be added as preferred components of the tablets in accord with the invention. By organic polymeric compound it is meant essentially any polymeric organic compound commonly used as dispersants, and anti-redeposition and soil suspension agents in detergent tablets.

Organic polymeric compound is typically incorporated in the detergent tablets of the invention at a level of from 0.1% to 30%, preferably from 0.5% to 15%, most preferably from 1% to 10% by weight of the tablets.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N by Rohm and Haas.

Preferred acrylic acid containing copolymers include those which contain as monomer units:a) from 90% to 10%, preferably from 80% to 20% by weight acrylic acid or its salts and b) from 10% to 90%, preferably from 20% to 80% by weight of a substituted acrylic monomer or its salts having the general formula $—[CR_2—CR_1(CO—O—R_3)]—$ wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Clay Softening System

The detergent tablets may contain a clay softening system comprising a clay mineral compound and optionally a clay flocculating agent.

The clay mineral compound is preferably a smectite clay compound. Smectite clays are disclosed in the U.S. Pat. Nos. 3,862,058, 3,948,790, 3,954,632 and 4,062,647. European Patents No.s EP-A-299,575 and EP-A-313,146 in the name of the Procter and Gamble Company describe suitable organic polymeric clay flocculating agents.

Lime Soap Dispersant Compound

The tablets of the invention may contain a lime soap dispersant compound, preferably present at a level of from 0.1% to 40% by weight, more preferably 1% to 20% by weight, most preferably from 2% to 10% by weight of the tablets.

A lime soap dispersant is a material that prevents the precipitation of alkali metal, ammonium or amine salts of fatty acids by calcium or magnesium ions. Preferred lime soap disperant compounds are disclosed in PCT Application No. WO93/08877.

Suds Suppressing System

The tablets of the invention, when formulated for use in machine washing tablets, preferably comprise a suds suppressing system present at a level of from 0.01% to 15%, preferably from 0.05% to 10%, most preferably from 0.1% to 5% by weight of the tablet.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 and EP-A-705 324.

Polymeric Dye Transfer Inhibiting Agents

The tablets herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The detergent tablets particularly those suitable for use in laundry washing methods optionally contain from 0.005% to 5% by weight of certain types of hydrophilic optical brighteners.

Hydrophilic optical brighteners useful herein include those having the structural formula:

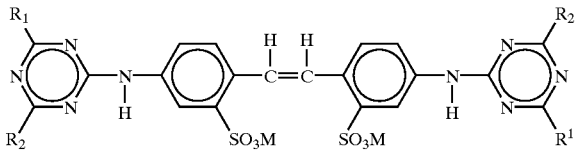

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent tablets herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Cationic Fabric Softening Agents

Cationic fabric softening agents can also be incorporated into tablets for use in laundry washing methods in accordance with the present invention. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from 0.5% to 15% by weight, normally from 1% to 5% by weight.

Other Optional Ingredients

Other optional ingredients suitable for inclusion in the tablets of the invention include perfumes, colours and filler salts, with sodium sulfate being a preferred filler salt.

pH of the Tablets

The detergent tablets used in the present invention are preferably not formulated to have an unduly high pH, in preference having a pH measured as a 1% solution in distilled water of from 8.0 to 12.5, more preferably from 9.0 to 11.8, most preferably from 9.5 to 11.5.

Machine Dishwashing Method

Any suitable methods for machine washing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a detergent tablet tablet in accord with the invention. By an effective amount of the detergent tablet tablet it is meant from 8 g to 60 g of product dissolved or dispersed in a wash solution of volume from 3 to 10 liters, as are typical product dosages and wash solution volumes commonly employed in conventional machine dishwashing methods. Preferably the detergent tablets are from 15 g to 40 g in weight, more preferably from 20 g to 35 g in weight.

Laundry Washing Method

Machine laundry methods herein typically comprise treating soiled laundry with an aqueous wash solution in a washing machine having dissolved or dispensed therein an effective amount of a machine laundry detergent tablet tablet in accord with the invention. By an effective amount of the detergent tablet tablet it is meant from 40 g to 300 g of product dissolved or dispersed in a wash solution of volume from 5 to 65 liters, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 001.1502, and 0011968. A convenient form of water frangible closure comprises a water soluble adhesive disposed along and sealing one edge of a pouch formed of a water impermeable polymeric film such as polyethylene or polypropylene.

EXAMPLES

Abbreviations Used in Examples

In the detergent compositions, the abbreviated component identifications have the following meanings:

| | |
|---|---|
| STPP: | Sodium tripolyphosphate |
| Citrate: | Tri-sodium citrate dihydrate |
| Carbonate: | Anhydrous sodium carbonate |
| Silicate: | Amorphous Sodium Silicate ($SiO_2$:$Na_2O$ ratio = 1.6–3.2) |
| PB1: | Anhydrous sodium perborate monohydrate |
| PB4: | Sodium perborate tetrahydrate of nominal formula $NaBO_2.3H_2O.H_2O_2$ |
| Plurafac: | $C_{13}$–$C_{15}$ mixed ethoxylated/propoxylated fatty alcohol nonionic surfactant with an average degree of ethoxylation of 3.8 and an average degree of propoxylation of 4.5, sold under the tradename Plurafac by BASE |
| SLF 18B-46: | Epoxy-capped poly(oxyalkylated) alcohol nonionic surfactant supplied by Olin Corporation under the trade name SLF18B-46 (cloud point = 6 C). |
| TAED: | Tetraacetyl ethylene diamine |
| HEDP: | Ethane 1-hydroxy-1,1-diphosphonic acid |
| DETPMP: | Diethyltriamine penta (methylene) phosphonate, marketed by monsanto under the tradename Dequest 2060 |
| MnTACN: | Manganese 1,4,7-trimethyl-1,4,7-triazacyclononane. |
| PAAC: | Pentaamine acetate cobalt (III) salt |
| Paraffin: | Paraffin oil sold under the tradename Winog 70 by Wintershall. |
| Protease: | Proteolytic enzyme of activity 20 KNPU/g sold under the tradename FN3 by Genecor International Inc. |
| Amylase: | Amylotic enzyme of activity 60 KNPU/g sold under the tradename Termamyl 60T by Novo Industries A/S. |
| BTA: | Benzotriazole |
| PA30: | Polyacrylic acid of average molecular weight approximately 4,500 |
| MA/AA: | Randon copolymer of 4:1 acrylate/maleate, average molecular weight about 70,000 |
| Sulphate: | Anhydrous sodium sulphate. |
| pH: | Measured as a 1% solution in distilled water at 20° C. |

In the following examples all levels are quoted as % by weight of the composition:

In the following examples all levels are quoted as % by weight of the composition:

Example 1

Composition A is a comparative example wherein the detergent tablet was prepared using conventional methods; the detergent components are mixed together in a suitable mixer to form a detergent composition. The nonionic surfacatant (plurafac) is then sprayed onto the detergent composition. The detergent composition is then delivered into the tablet press and compressed to form a tablet using a compression pressure of 13 KN/cm$^2$. The detergent tablet compositions, examples B to F were prepared in accord with the process of the present invention. The detergent components are mixed as per the described process and delivered to a tablet press. The tablet is prepared by compression of the detergent composition using a compression pressure of 10 KN/cm$^2$ in a standard 12 head rotary press:

| | A | B | C | D | E | F |
|---|---|---|---|---|---|---|
| STPP | 48.23 | 48.80 | 49.20 | 52.0 | — | 46.80 |
| Citrate | — | — | — | — | 31.10 | — |
| Carbonate | — | 5.0 | 14.0 | 14.40 | 14.40 | 23.0 |
| Silicate | 26.40 | 14.80 | 15.0 | 12.60 | 17.70 | 2.40 |
| Protease | 1.76 | 2.20 | 1.26 | 1.0 | 1.60 | 0.40 |
| Amylase | 1.20 | 1.50 | 1.50 | 0.85 | 2.0 | 0.30 |
| PB1 | 1.56 | 7.69 | 12.20 | 10.60 | 15.70 | — |
| PB4 | 6.92 | — | — | — | — | 14.40 |
| Plurafac | 1.50 | — | — | — | — | — |
| SLF 18B-6 | — | 1.5 | 1.50 | 1.7 | 1.5 | 2.0 |
| PAAC | — | — | 0.016 | 0.009 | — | — |
| MnTACN | — | — | — | — | 0.007 | — |
| TAED | 4.33 | 2.50 | — | — | 1.30 | 1.84 |
| HEDP | 0.67 | — | — | 0.7 | — | 0.40 |
| DETPMP | 0.65 | — | — | — | — | — |
| Paraffin | 0.42 | 0.50 | 0.5 | 0.55 | — | — |
| BTA | 0.24 | 0.30 | 0.3 | 0.33 | — | — |
| PA30 | 3.2 | — | — | — | — | — |
| MA/AA | — | — | — | — | 4.51 | 0.55 |
| Perfume | — | — | 0.05 | 0.05 | 0.20 | 0.2 |
| Sulphate | 24.05 | 13.0 | 2.29 | — | 10.68 | 3.41 |
| Misc/water to balance | | | | | | |
| pH (1% solution) | 10.60 | 10.60 | 10.7 | 10.7 | 10.9 | 11.2 |
| weight of tablet | 25 g | 25 g | 20 g | 30 g | 20 g | 25 g |

What is claimed is:

1. A detergent tablet comprising a nonionic surfactant having a melting point greater than 25° C. and wherein the detergent tablet is obtainable by a process comprising the steps of:

a) heating the nonionic surfactant to above its melting point to form a liquid nonionic surfactant; and b) applying the liquid nonionic surfactant to a premix of detergent components to form a detergent composition; and c) forming the detergent composition into tablets;

wherein the nonionic surfactant is selected from the group of consisting of:

i) surfactants having the general formula:

$$R_1O[CH_2CH(CH_3)O]_x[CH_2CH_2O]_y[CH_2CH(OH)R_2]_l$$

wherein $R_1$ is a linear or branched, aliphatic hydrocarbon radical having from 4 to 12 carbon atoms including mixtures thereof; $R_2$ is a linear or branched aliphatic hydrocarbon radical having from 2 to 10 carbon atoms including mixtures thereof; x is an integer having an average value of from 0.5 to 1.5; and y is an integer having a value of least 15;

ii) surfactants having the general formula:

$$R_1O[CH_2CH(CH_3)O]_x[CH_2CH_2O]_y[CH_2CH(OH)R_2]_2$$

wherein $R_1$ is a linear or branched, aliphatic hydrocarbon radical having from 4 to 12 carbon atoms including mixtures thereof; $R_2$ is a linear or branched aliphatic hydrocarbon radical having from 2 to 10 carbon atoms including mixtures thereof; x is an integer having an average value of from 0.5 to 1.5; and y is an integer having a value of least 15;

iii) surfactants having the general formula:

$$R_1O[CH_2CH(CH_3)O]_x[CH_2CH_2O]_y[CH_2CH(OH)R_2]_3$$

wherein $R_1$ is a linear or branched, aliphatic hydrocarbon radical having from 4 to 12 carbon atoms including mixtures thereof; $R_2$ is a linear or branched aliphatic hydrocarbon radical having from 2 to 10 carbon atoms including mixtures thereof; x is an integer having an average value of from 0.5 to 1.5; and y is an integer having a value of least 15; and iv) mixtures thereof.

2. A detergent tablet according to claim 1 wherein at ambient temperature the nonionic surfactant is a solid, wax or highly viscous liquid of at least 20,000 cps.

3. A detergent tablet according to claim 1 wherein the difference between the temperature of the premix of detergent components and the nonionic surfactant is less than 30° C.

4. A detergent tablet according to claim 1 wherein the detergent tablet is formed using a compression pressure of between 5 and 13KN/cm$^2$.

5. A detergent tablet according to claim 1 wherein the tablet is ejected from the tablet press using an ejection force of less than 40KN.

6. A detergent tablet according to claim 5 wherein the tablet is ejected from the tablet press using an ejection force of less than 10KN.

7. A detergent tablet according to claim 1 wherein the tablet is ejected from the tablet press after the tablets have cooled to a temperature at least 5° C. below the melting point of the nonionic surfactant.

* * * * *